US012134873B2

(12) United States Patent
Coulson

(10) Patent No.: US 12,134,873 B2
(45) Date of Patent: Nov. 5, 2024

(54) BUCKET FOR AN EARTH-WORKING OR MATERIALS-HANDLING MACHINE

(71) Applicant: SSAB TECHNOLOGY AB, Stockholm (SE)

(72) Inventor: Brian Coulson, Durham (GB)

(73) Assignee: SSAB TECHNOLOGY AB, Stockholm (SE)

( * ) Notice: Subject to any disclaimer, the term of this patent is extended or adjusted under 35 U.S.C. 154(b) by 326 days.

(21) Appl. No.: 17/299,045

(22) PCT Filed: Dec. 6, 2019

(86) PCT No.: PCT/EP2019/084028
§ 371 (c)(1),
(2) Date: Jun. 2, 2021

(87) PCT Pub. No.: WO2020/115298
PCT Pub. Date: Jun. 11, 2020

(65) Prior Publication Data

US 2022/0042275 A1 Feb. 10, 2022

(30) Foreign Application Priority Data

Dec. 7, 2018 (EP) ..... 18211071

(51) Int. Cl.
*E02F 3/40* (2006.01)
*E02F 9/28* (2006.01)

(52) U.S. Cl.
CPC ..... *E02F 3/40* (2013.01); *E02F 9/2883* (2013.01)

(58) Field of Classification Search
CPC ..... E02F 3/40; E02F 3/14; E02F 3/12; E02F 9/2883
See application file for complete search history.

(56) References Cited

U.S. PATENT DOCUMENTS 2,393,432 A * 1/1946 Turner ..... E02F 3/60 414/916
3,249,245 A 5/1966 Foster
(Continued)

FOREIGN PATENT DOCUMENTS

CN 201095774 8/2008
CN 103097615 A 5/2013
(Continued)

OTHER PUBLICATIONS

U.S. Appl. No. 17/290,865, filed May 3, 2021, SSAB Technology AB.
(Continued)

*Primary Examiner* — Adam J Behrens
*Assistant Examiner* — Blake E Scoville
(74) *Attorney, Agent, or Firm* — Ballard Spahr LLP

(57) ABSTRACT

Disclosed is a bucket for an earth-working or materials-handling machine having a top portion, a first and a second bucket side wall, a bucket floor extending from a front cutting edge up to the top portion, wherein the front cutting edge, the first and second side walls and the top portion form a bucket opening, seen from a front view of the bucket, the bucket floor has an inside facing towards the bucket opening and an outside facing away from the bucket opening, characterized in that the bucket floor has at least one floor section being attached to the bucket floor, optionally by at least one weld interface between the at least one floor section and the bucket floor provided in the proximity of the front cutting edge; and at least one protection element for protecting at least a part of the floor section, and/or at least a part of the optional at least one weld interface, which at least one protection element is mounted on the inside of the bucket floor in the proximity of the front cutting edge.

14 Claims, 4 Drawing Sheets

(56) References Cited

U.S. PATENT DOCUMENTS

| | | | | |
|---|---|---|---|---|
| 3,578,375 | A | 5/1971 | Finefrock | |
| 3,791,054 | A * | 2/1974 | Bierwith | E02F 9/2866 37/189 |
| 4,043,060 | A * | 8/1977 | Stepe | E02F 9/2841 37/446 |
| 4,110,921 | A | 9/1978 | Poker, Jr. | |
| 4,129,952 | A | 12/1978 | Olson | |
| 4,476,641 | A | 10/1984 | Ballinger | |
| 5,063,694 | A | 11/1991 | McCreary | |
| 5,680,717 | A | 10/1997 | Bierwith | |
| 8,052,193 | B2 | 11/2011 | Liebert | |
| 8,464,443 | B2 | 1/2013 | Torgrimsen | |
| 9,428,881 | B1 * | 8/2016 | Chabura | E02F 3/40 |
| 9,957,688 | B2 * | 5/2018 | Hall | E02F 3/40 |
| 9,995,285 | B2 | 6/2018 | Ehrsam | |
| 10,815,638 | B2 | 10/2020 | Voelz et al. | |
| 2005/0095109 | A1 * | 5/2005 | Harris | E02F 3/40 414/722 |
| 2008/0282585 | A1 | 11/2008 | Cox | |
| 2009/0183398 | A1 | 7/2009 | McClallen et al. | |
| 2013/0164106 | A1 | 6/2013 | Clause et al. | |
| 2015/0110592 | A1 | 4/2015 | Voelz | |
| 2016/0046244 | A1 | 2/2016 | Chewning | |
| 2016/0130791 | A1 | 5/2016 | Serrurier et al. | |
| 2017/0314236 | A1 * | 11/2017 | Long | E02F 9/2883 |

FOREIGN PATENT DOCUMENTS

| | | | | |
|---|---|---|---|---|
| CN | 104011303 | A | 6/2013 | |
| CN | 105765131 | A | 7/2016 | |
| CN | 206346240 | | 7/2017 | |
| FR | 2 691 126 | A | 11/1993 | |
| GB | 2 272 008 | | 5/1994 | |
| JP | S51131001 | | 10/1976 | |
| JP | S5244601 | | 4/1977 | |
| JP | H0720336 | | 4/1995 | |
| JP | 2014070430 | | 4/2013 | |
| JP | 2014070430 | A * | 4/2014 | E02F 3/402 |
| JP | 2017014751 | A | 1/2017 | |
| KR | 20130002388 | U * | 4/2013 | |
| KR | 20130107705 | | 10/2013 | |
| RU | 39147 | U1 | 7/2004 | |
| RU | 2429146 | | 9/2011 | |
| WO | WO 2013/032429 | | 3/2013 | |
| WO | WO 2015/006809 | | 1/2015 | |
| WO | WO 2016/061609 | | 4/2016 | |
| WO | WO-2016061609 | A1 * | 4/2016 | E02F 3/40 |
| WO | WO 2020/115298 | | 6/2020 | |
| WO | WO 2020/115300 | | 6/2020 | |

OTHER PUBLICATIONS

U.S. Appl. No. 17/299,041, filed Jun. 2, 2021, SSAB Technology AB.

PCT, PCT/EP2019/084023 (WO 2020/115295), Dec. 6, 2019, SSAB Technology AB.

PCT, PCT/EP2019/084031 (WO 2020/115300), Dec. 6, 2019, SSAB Technology AB.

International Search Report and Written Opinion were mailed on Feb. 10, 2020 by the International Searching Authority for International Application No. PCT/EP2019/084031, filed on Dec. 6, 2019 and published as WO 2020/115300 on Jun. 11, 2020 (Applicant—SSAB Technology AB, (10 Pages).

International Search Report and Written Opinion were mailed on Feb. 3, 2020 by the International Searching Authority for International Application No. PCT/EP2019/084028, filed on Dec. 6, 2019 and published as WO 2020/115298 on Jun. 11, 2020 (Applicant—SSAB Technology AB, (11 Pages).

International Search Report and Written Opinion were mailed on Feb. 3, 2020 by the International Searching Authority for International Application No. PCT/EP2019/084023, filed on Dec. 6, 2019 and published as WO 2020/115295 on Jun. 11, 2020 (Applicant—SSAB Technology AB, (12 Pages).

Hiroshi Sunada, "Development of Wear-resistant Bucket (e-Bucket) for PC200 Series," Komatsu Technical Report, vol. 50, No. 103, (Dec. 1, 2004) pp. 1-6.

* cited by examiner

BUCKET FOR AN EARTH-WORKING OR MATERIALS-HANDLING MACHINE

CROSS-REFERENCE TO RELATED APPLICATIONS

This application is a U.S. National Phase Application of International Application No. PCT/EP2019/084028, filed Dec. 6, 2019, which claims priority to European Application No. 18211071.8, filed Dec. 7, 2018, each of which are hereby incorporated by reference in their entirety.

TECHNICAL FIELD

The present disclosure relates to a bucket for an earth-working or materials-handling machine, the bucket comprising a top portion, a first and a second bucket side wall, and a bucket floor extending from a front cutting edge of up to the top portion, wherein the front cutting edge, the first and second side walls and the top portion form a bucket opening, seen from a front view of the bucket.

BACKGROUND

Earth-working or materials-handling machines, such as excavators, are widely used in the construction and mining industries to move material, such as earth, sand, rocks and snow. In many of these applications, buckets are used to pick up and transport material and for example load it onto a truck or move it to a different location.

Such buckets are exposed to a high degree of abrasive wear and it is known to mount wear components (also known as heel segments, heel blocks, cast heels, corners, corner guards, corner shrouds, wear strips or wear plates) on the outer surface of the bucket around the connection between the floor and a side wall of the bucket which forms a bucket corner edge. The wear components provide additional strengthening and abrasion resistance at the bucket corner edges and thereby prolong the working life of the bucket.

Wear resistant steel is often used to manufacture such buckets and the welding and heat-intensive cutting operations that are used when manufacturing the bucket may result in the formation of a heat-affected zone (HAZ), which is the area of base material that is not melted and that has had its microstructure and properties altered by the welding or cutting operations. The heat from a welding and/or cutting process and subsequent re-cooling may thereby adversely affect the steel around the weld interface and consequently weaken the bucket in the HAZ.

Since buckets for earth-working or materials-handling machines are usually quite large and heavy, moving and supporting bucket parts, such as the floor and the side walls of the bucket, while they are being welded together can make the manufacturing process and repair or maintenance work quite complex and time consuming.

Such buckets are commonly provided in different sizes, to thereby be adapted for machines, such as excavators, having different lifting capacity and/or maximum suspended load. The lifting capacity is defined as the maximum weight the machine may lift. When picking up a material, the weight of a bucket per se must be considered. A heavy bucket would inevitably deteriorate the actual load weight and work efficiency even for excavators of the same lifting capacity.

SUMMARY

In view of the above, an object of the present disclosure is to provide a bucket for an earth-working or materials-handling machine, which bucket has improved work efficiency.

The bucket according to the present disclosure has the advantage of high abrasion resistance and prolonged lifespan.

The bucket according to the present disclosure has the advantage of high ratio of actual load weight and lifting capacity. The expression "actual load weight" as used herein means the maximal actual load weight that can be lifted or picked up by an earth-working or materials-handling machine with a lifting capacity. At a fixed lifting capacity the actual load weight is determined by the type of bucket and the type of material to be lifted.

It is further an advantage that the working speed of an earth-working or materials-handling machine can be increased by using the bucket according to the present disclosure.

It is another object of the present disclosure to provide a bucket that can be manufactured, repaired and/or maintained in a more cost-effective manner.

According to the present disclosure, the objects are achieved by the subject matter as defined in claim 1. Further embodiments of the disclosure may be found in the dependent claims and in the accompanying description and drawings.

The objects are achieved by a bucket for an earth-working or materials-handling machine, comprising, a top portion, a first and a second bucket side wall, a bucket floor extending from a front cutting edge up to the top portion, wherein the front cutting edge, the first and second side walls and the top portion form a bucket opening, seen from a front view of the bucket. The bucket floor has an inside facing towards the bucket opening and an outside facing away from the bucket opening. The bucket floor comprises at least one floor section being attached to the bucket floor, optionally by at least one weld interface between the at least one floor section and the bucket floor provided in the proximity of the front cutting edge; and at least one protection element for protecting at least a part of the floor section (11), and/or at least a part of the optional at least one weld interface, which at least one protection element is mounted on the inside of the bucket floor in the proximity of the front cutting edge.

Optionally, the floor section is an inverted keel section with a trough portion on the outside and a ridge portion on the inside.

The term "keel section" as used herein means a section of a floor having a trough portion on one side of the floor and a ridge portion on an opposite side of the floor, which portions extend in a longitudinal extension of the floor. Normally, a "keel section" is having a trough portion on the inside of the floor and a ridge portion on the outside of the floor, such as a normal keel section of a ship or boat. Hence, the term "inverted keel section" as used herein means a keel section having a trough portion on the outside of the floor and a ridge portion on the inside of the floor.

The inverted keel section have reduced friction due to reduced normal force the inverted keel section is subjected to, which makes it possible that the working speed of an earth-working or materials-handling machine can be increased by using the bucket according to the present disclosure. The expression "normal force" as used herein means a contact force that is perpendicular to the surface that an object contacts.

Furthermore, the inverted keel section may guide the material flow within the bucket such that the abrasion resistance of the bucket floor is enhanced, making it possible to decrease the weight of the bucket without compromising the abrasion resistance, which improves the ratio of actual load weight and lifting capacity.

Optionally, the at least one protection element is attached to the bucket floor by at least one weld interface between the at least one protection element and the bucket floor.

Optionally, the at least one protection element is detachably attached to the bucket floor by at least one mechanical fastening means.

Optionally, the at least one protection element is at least detachably attached to the floor section. Thus, the protection element may provide an extra fastening means connecting the floor section with the bucket floor.

Optionally, the at least one mechanical fastening means is a bolt and/or a screw and/or a quick-lock-mechanism and/or a quick-release-mechanism.

Optionally, the at least one protection element extends from the proximity of the front cutting edge and over at least a portion of the floor section, and/or at least a portion of the optional at least one weld interface between the at least one floor section and the bucket floor. Still optionally, when the floor section is an inverted keel section, the protection element further extends over at least a portion of the ridge portion.

Optionally, the at least one protection element has a tapered end in the proximity of the front cutting edge.

Optionally, the at least one protection element has a substantially triangular form with one vertex in the direction towards the front cutting edge.

Optionally, the at least one protection element consists of one single piece of material.

Optionally, the bucket floor comprises a first and a second rail section.

The combination of the prima facie unrelated structures, i.e. the at least one inverted keel section and the rail sections, may unexpectedly provide enhanced abrasion resistance of the bucket floor. This makes it possible to reduce the average thickness and weight of the bucket floor without compromising abrasion resistance, which is beneficial to improving the ratio of actual load weight and lifting capacity of the bucket. Further, by the provision of the present invention, dents on the bucket floor caused during use of the bucket may be avoided. This is achieved by providing the inverted keel section and the rail sections, where the rail sections are intended to accommodate a main portion of the loads from the outside on the bucket floor during digging. Still further, by the provision of the invention as disclosed herein, additional wear parts provided on the outside of the bucket floor may be avoided. Thereby, the bucket weight may be reduced, and also a more cost-efficient bucket having fewer parts may be provided.

Optionally, each one of the rail sections comprises at least one detachable wear component connected to the bucket floor.

Optionally, the at least one floor section, preferably the at least one inverted keel section, is provided in-between the first and second rail sections, as seen in a width w' direction of the bucket.

Optionally, a maximum width of the at least one inverted keel section may extend over at least 30% of the width of the bucket floor, such as over at least 40% or 50% thereof. Optionally, the floor section has a width w which tapers in a direction towards the front cutting edge, forming a tapering floor portion in the proximity of the front cutting edge, and wherein the optional at least one weld interface between the at least one floor section and the bucket floor is provided along an edge of the tapering floor portion.

BRIEF DESCRIPTION OF THE DRAWINGS

With reference to the appended drawings, below follows a more detailed description of embodiments of the disclosure cited as examples.

In the drawings.

Figure 1:
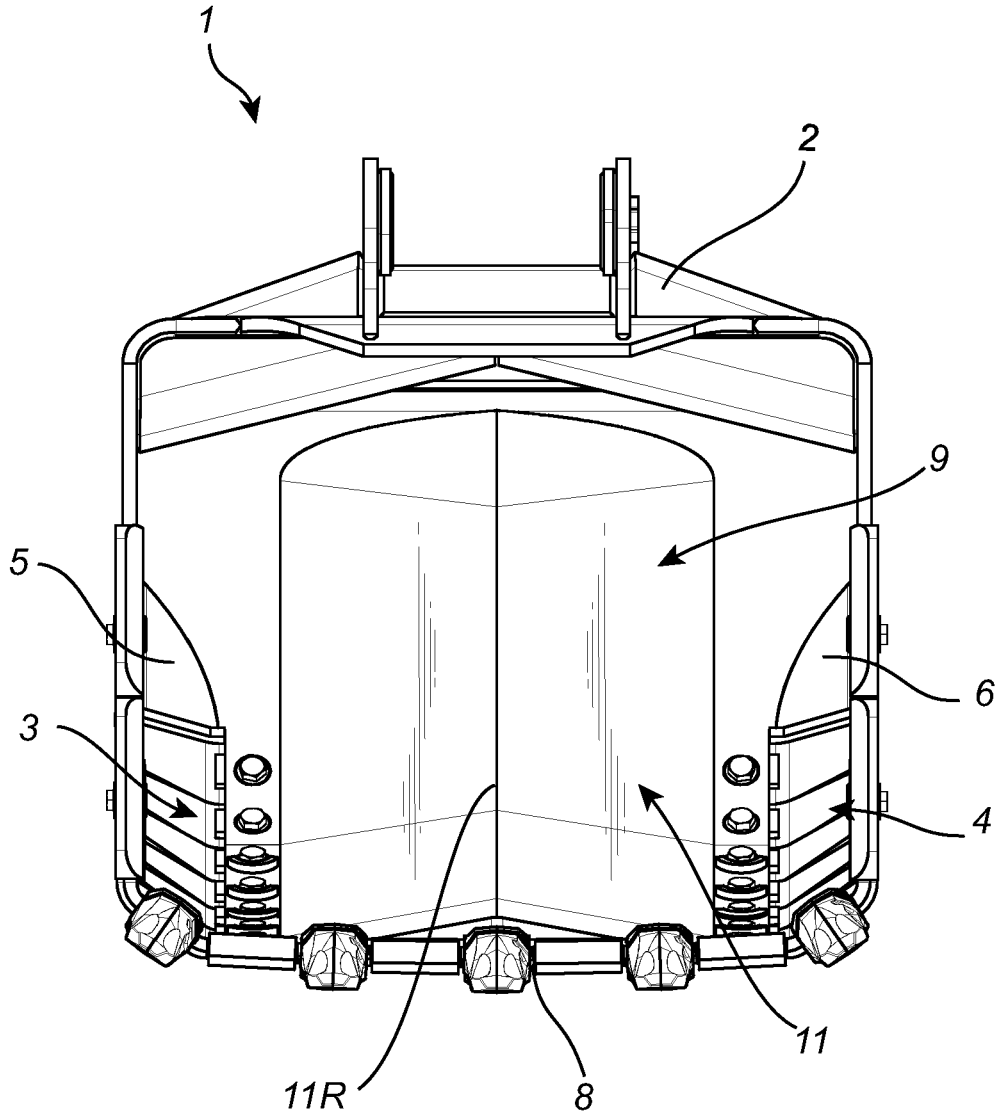
FIG. 1 shows a front view of a bucket according to an embodiment of the present disclosure.

The drawings show diagrammatic exemplifying embodiments of the present disclosure and are thus not necessarily drawn to scale. It shall be understood that the embodiments shown and described are exemplifying and that the invention is not limited to these embodiments. It shall also be noted that some details in the drawings may be exaggerated in order to better describe and illustrate the particular embodiment. Like reference characters refer to like elements throughout the description, unless expressed otherwise.

DETAILED DESCRIPTION OF PREFERRED EMBODIMENTS

A bucket according to embodiments described herein is suitable for use with any earthmoving or materials-handling machine, such as a compact excavator, a dragline excavator, amphibious excavator, power shovel, steam shovel, suction excavator, walking excavator, bucket wheel excavator, a bulldozer, a loader, mining equipment, a tractor, a skid steer loader etc. The earth-moving or materials-handling machine may be a ground engaging machine, or may have a bucket that is arranged to engage some other surface, such as a pit wall in open pit mining.

The earth-moving or materials-handling machine may for example be used for digging a trench, hole or foundations, in forestry work, construction, landscaping, mining, river dredging or snow removal.

The bucket 1 comprises a top portion 2, a first 5 and a second 6 bucket side wall, a bucket floor 7 extending from a front cutting edge 8 up to the top portion 2, wherein the front cutting edge 8, the first 5 and second 6 side walls and the top portion 2 form a bucket opening 9, seen from a front view of the bucket 1. FIG. 1 is a front view of a bucket 1 according to an embodiment of the present disclosure.

Figure 2:
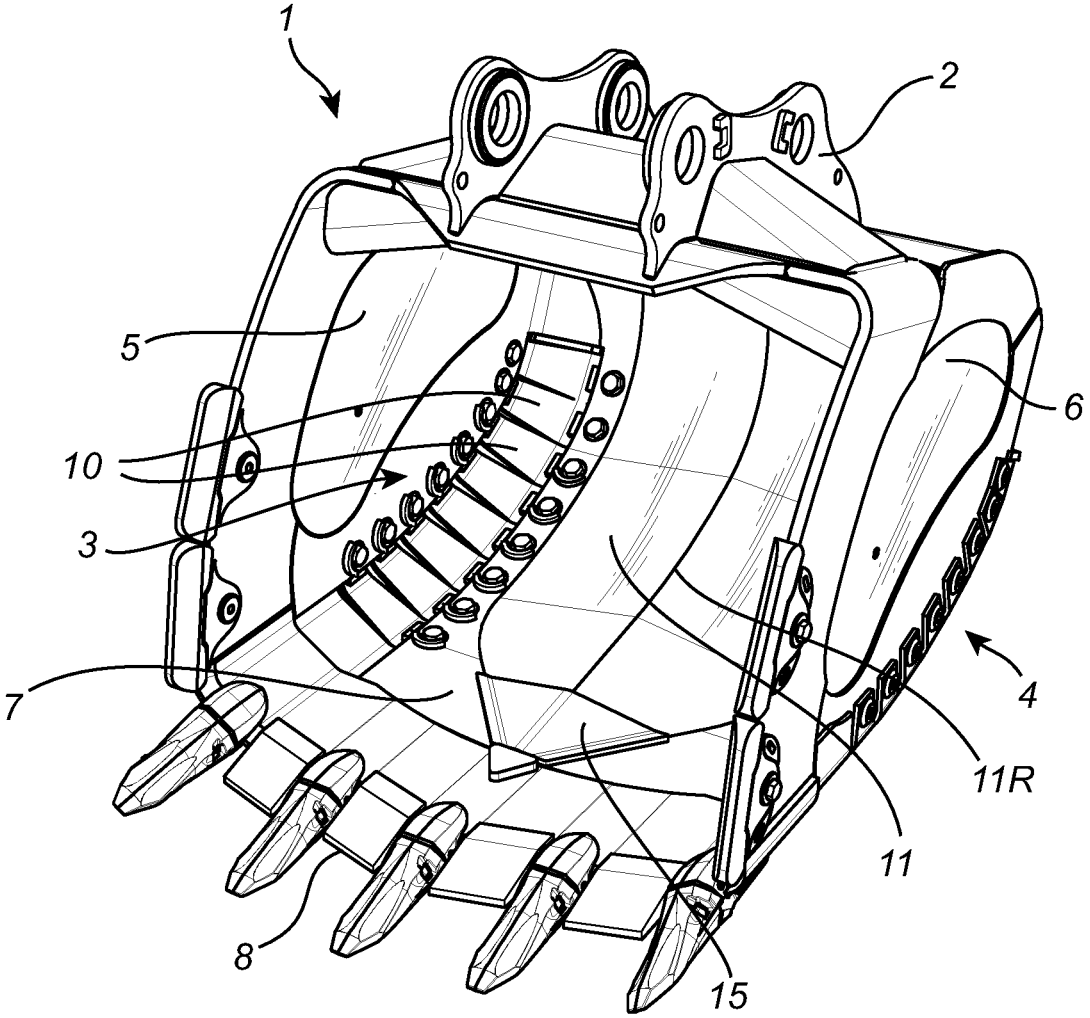
FIG. 2 shows a side view of a bucket according to an embodiment of the present disclosure.
Figure 3:
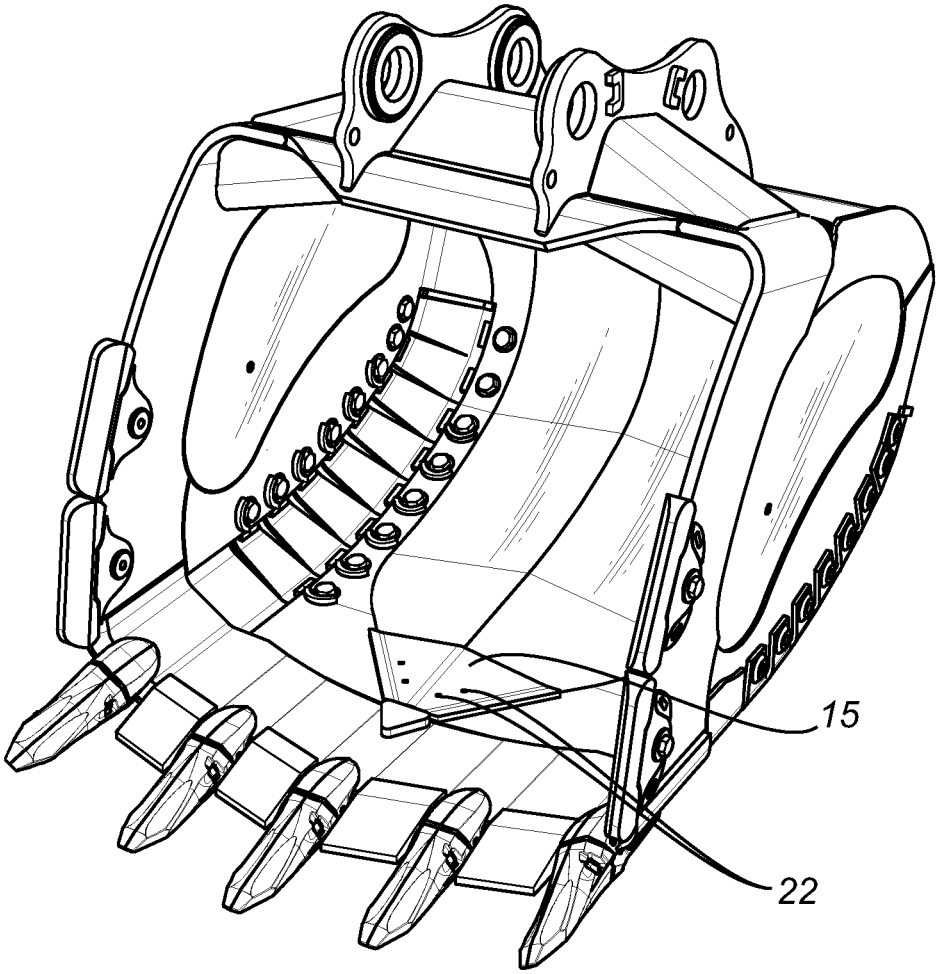
FIG. 3 shows a side view of a bucket according to an embodiment of the present disclosure.

Preferably the bucket floor 7 and each of the side walls 5, 6 are connected at an angle of 90° (FIGS. 2 and 3). But there is no vertex from which an angle can be measured in the region where the floor and side wall of the bucket are connected. Such a lack of a 90° corner inside the bucket may facilitate the loading and unloading of the bucket since it may prevent material or objects from getting stuck in the inside corners of the bucket.

The bucket floor 7 has an inside facing towards the bucket opening 9 and an outside facing away from the bucket opening 9. Preferably, the bucket floor has a rounded/curved shape when extending from a front cutting edge 8 of the bucket up to the top portion (FIGS. 2 and 3). The curved and/or continuous inside of the bucket floor may result in improved flow characteristics of material across the inner surface of the bucket when loading and unloading the bucket leading to less material becoming trapped in the inside corners of the bucket and/or less "hang up" of material in the bucket. The curved and/or continuous outside of the bucket floor 7 may have reduced friction due to reduced normal force the bucket floor 7 is subjected to.

The bucket floor 7 comprises at least one floor section 11 being attached to the bucket floor 7, optionally by at least one weld interface between the at least one floor section 11 and the bucket floor 7 provided in the proximity of the front cutting edge 8; and at least one protection element 15 for protecting at least a part of the floor section 11, and/or at least a part of the optional at least one weld interface, which at least one protection element 15 is mounted on the inside of the bucket floor 7 in the proximity of the front cutting edge 8.

The floor section 11 may be an integral part of the bucket floor 7. Optionally, the bucket floor 7 with the at least one floor section 11 is made from one and the same piece of sheet metal, preferably by bending and/or forming the sheet metal. This configuration provides enhanced strength of the bucket floor and enables cost-efficient manufacturing process. Further, it provides a light-weight configuration with reduced number of separate components.

The protection element 15 increases the abrasion resistance of the bucket floor 7 and the at least one floor section 11 in the direction of flow of material into or outwards of the bucket 1 when the bucket is in use. The protection element 15 serves to protect at least a part of the floor section 11, and/or at least a part of the optional at least one weld interface (FIGS. 2 and 3) between the at least one floor section 11 and the bucket floor 7 provided in the proximity of the front cutting edge 8. The protection element 15 may also protect the heat-affected zone (HAZ) around the optional weld interface. Typically, the at least one protection element 15 may comprise wear and abrasion-resistant steel, hardened steel or case-hardened steel. The steel may have a Brinell hardness of at least 500, preferably a Brinell hardness of 525-575 or 25 more. According to an embodiment of the bucket, the at least one wear component comprises Hardox® wear plate.

Optionally, the at least one floor section 11 extends along at least a part of the bucket floor 7 in a direction from the front cutting edge 8 up to the top portion 2.

Optionally, the at least one floor section 11 consists of one single piece of sheet material. This improves strength of the floor section 11, thereby resulting in reduced risk of cracks when the bucket 1 is in use.

Optionally, the at least one floor section 11 consists of at least two pieces of sheet material which are attached to each other, preferably by at least one weld interface between the at least two pieces of sheet material. This is beneficial to forming a specific shape of the floor section, such as an inverted keel section, which also enables cost reduction of manufacturing, repair and/or maintenance of the bucket.

Optionally, the floor section 11 is an inverted keel section with a trough portion 11T on the outside and a ridge portion 11R on the inside (FIGS. 2 and 3). The inverted keel section 11 may preferably be made of one or more pieces of sheet metal. The inverted keel section 11 may for example be formed by bending and/or forming the sheet metal, or by any other manufacturing operation known to the skilled person. In view of the above, a robust and light-weight inverted keel section can be provided.

The at least one inverted keel section 11 makes it possible that the average thickness and weight of the bucket floor 7 may be reduced without compromising abrasion resistance.

The trough portion 11T of the at least one inverted keel section 11 may be subjected to less normal force, thereby reducing the friction generated between the trough portion 11T and the material to be loaded or unloaded. The reduction in friction leads to improved working speed and efficiency of an earth-working or materials-handling machine using the bucket 1.

The ridge portion 11R of the at least one inverted keel section 11 may control the flow characteristics of material within the bucket 1 such that the material flows in the direction towards the region where the bucket floor 7 and side wall are connected.

Optionally, in one embodiment as shown in FIG. 2, the at least one protection element 15 is attached to the bucket floor 7 by at least one weld interface between the at least one protection element 15 and the bucket floor 7.

Optionally, in one embodiment as shown in FIG. 3, the at least one protection element 15 is detachably attached to the bucket floor 7 by at least one mechanical fastening means 22. The at least one mechanical fastening means 22 may be a bolt and/or a screw and/or a stud and/or a quick-lock-mechanism and/or a quick-release-mechanism. This may facilitate cost reduction of manufacturing the bucket 1 and replacement protection elements.

Optionally, the at least one protection element 15 is at least detachably attached to the floor section 11 (FIGS. 2 and 3). Thus, the at least one protection element 15 may provide an extra fastening means connecting the at least one floor section 11 with the bucket floor 7.

Optionally, the at least one protection element 15 extends from the proximity of the front cutting edge 8 and over at least a portion of the floor section 11, and/or at least a portion of the optional at least one weld interface between the at least one floor section 11 and the bucket floor 7 (FIGS. 2 and 3). Still further, the protection element may also extend over at least a portion of the ridge portion 11R. The ridge portion 11R in the proximity of the front cutting edge 8 is thereby protected from material entering the inside of the bucket during use.

Optionally, the at least one protection element 15 has a tapered end in the proximity of the front cutting edge 8. The tapered end may improve the flow characteristics of material into or outwards of the bucket when the bucket is in use. This provides better protection of at least a part of the floor section 11, and/or at least a part of the optional at least one weld interface between the at least one floor section 11 and the bucket floor 7, and/or the heat-affected zone (HAZ) around the optional weld interface.

Optionally, in the embodiments as shown in FIGS. 2 and 3, the at least one protection element 15 has a substantially triangular form with one vertex in the direction towards the front cutting edge 8. The substantially triangular formed protection element protects at least a part of the floor section 11, the optional weld interface between the inverted keel section and the bucket floor, and/or the heat-affected zone (HAZ) around the optional weld interface. Furthermore, the substantially triangular form may improve the flow characteristics of material into or outwards of the bucket when the bucket is in use.

Optionally, the at least one protection element 15 consists of one single piece of material. This improves strength of the protection element 15, thereby resulting in reduced risk of cracks when the bucket 1 is in use.

Optionally, in the embodiments as shown in FIGS. 2 and 3, the bucket floor 7 comprises a first 3 and a second 4 rail section. The rail sections 3, 4 function as supporting means on the outside of the bucket floor 7 when the bucket 1 stands still (FIGS. 2 and 3). When the bucket 1 is in use, the rail sections 3, 4 are intended to be subjected to a greater abrasion than other parts of the outside of the bucket floor 7. The presence of rail sections 3, 4 makes it possible to reduce the average thickness and weight of the bucket floor 7 without compromising abrasion resistance, which is further beneficial to improving the ratio of actual load weight and lifting capacity of the bucket 1.

When the bucket 1 is in use, the greatest abrasion arises upon contact of the bucket floor 7 with a ground surface, which likely comprises packed material. During digging, the front cutting edge 8 will cut through the packed material and thereby loosen up packed material which mainly will be filled into the bucket. The trough portion 11T of the at least one inverted keel section 11 creates a space between the harder ground surface and the bucket floor 7 such that mainly the rail sections 3, 4 of the bucket floor 7 will come into contact with the harder ground surface. The space on the other hand may accommodate excessive more loose material which may cause relatively less abrasion to the trough portion 11T compared to the harder ground surface. As a consequence of this configuration, the abrasion on the bucket floor 7 will mainly be provided onto the rail sections 3, 4. Thus, a bucket floor 7 can be designed such that the rail sections 3, 4 equipped with abrasion resistant and detachable wear components are more resistant to abrasion than other parts of the bucket floor 7 while the overall abrasion resistance of the bucket floor is at least not compromised compared to a prior art bucket floor with all parts in contact with the packed ground surface. This enables reduction in the average thickness and weight of the bucket floor 7 without compromising abrasion resistance.

Optionally, in one embodiment shown in e.g. FIG. 1, the front cutting edge 8 may further be formed such that the opening 9 at the front cutting edge 8 forms a concave-shaped profile facing the top portion 2, when seen from the front view of the bucket 1. This may further reduce abrasion to the trough portion 11T since the concavely shaped front cutting edge 8 may provide a cutting interface between the edge and the packed material which is located further below the trough portion 11T. Thereby, the concavely shaped front cutting edge may provide an even larger space between the harder ground surface and the bucket floor 7, when the bucket is in use.

The ridge portion 11R of the at least one inverted keel section 11 may control the flow characteristics of material within the bucket 1 such that the material flows in the direction towards the rail sections 3, 4, thereby disposing a majority of pressure from the loading weight to the rail sections 3, 4 which are equipped with abrasion resistant wear components. The expression "pressure" as used herein means the force applied perpendicular to the surface of an object per unit area over which that force is distributed.

Thus, the combination of the prima facie unrelated structures, i.e. the at least one inverted keel section 11 and the rail section 3, 4, may unexpectedly provide enhanced abrasion resistance of the bucket floor 7. This enables further reduction in the average thickness and weight of the bucket floor 7 without compromising abrasion resistance, which is beneficial to improving the ratio of actual load weight and lifting capacity of the bucket 1.

Optionally, in the embodiments as shown in FIGS. 2 and 3, each one of the rail sections 3, 4 comprises at least one detachable wear component 10 connected to the bucket floor 7. The at least one detachable wear component 10 of each one of the rail sections enhances abrasion resistance of the rail sections, which also makes it possible to manufacture, repair and/or maintain the bucket 1 in a more cost-effective manner.

Optionally, in the embodiments as shown in FIG. 1-3, the at least one floor section 11, preferably the at least one inverted keel section, is provided in-between the first 3 and second 4 rail sections, as seen in a width w' direction of the bucket (FIG. 4).

FIG. 4 shows cross-sectional views of the inverted keel section 11 according to four embodiments of the present disclosure, wherein w is the width of the inverted keel section 11, w' is the width of the bucket floor 7, w" is the width of the rail sections 3, 4, and h is the height of the ridge portion 11R. Typically, the width (w") of the rail section is in the range of 60 mm to 200 mm.

The height h of the ridge portion 11R may be the same along at least a part of the longitudinal direction of the inverted keel section 11. Alternatively, the height h of the ridge portion 11R may vary along at least a part of the longitudinal direction of the inverted keel section 11. This may improve the flow characteristics of material into or outwards of the bucket when the bucket is in use.

Figure 4A:
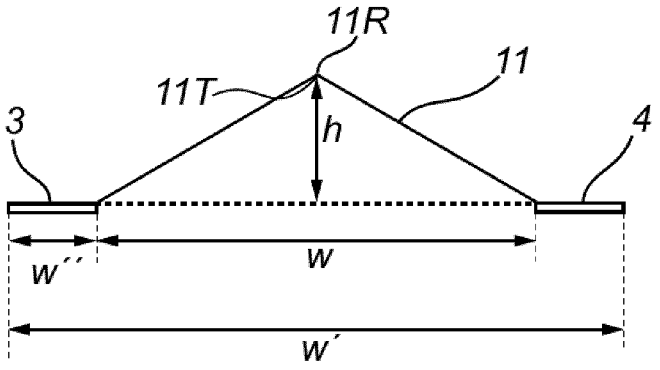
FIG. 4*a* shows a cross-sectional view of one inverted keel section according to an embodiment of the present disclosure.

In the embodiment as shown in FIG. 4*a* the inverted keel section 11 has a substantially triangular formed cross section. This embodiment may comprise the rail sections 3, 4, as shown, even though it also could be without such rail sections.

Figure 4B:
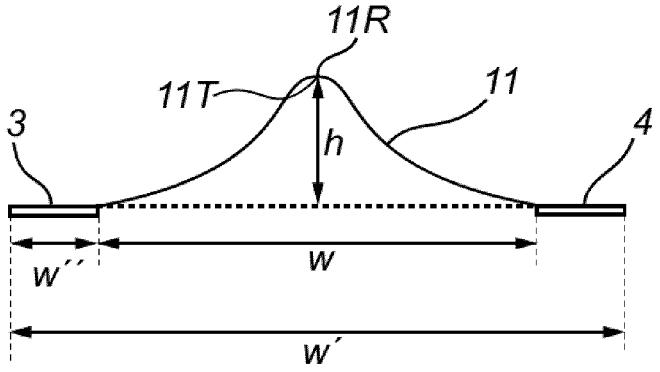
FIG. 4*b* shows a cross-sectional view of one inverted keel section according to an embodiment of the present disclosure.

In the embodiment as shown in FIG. 4*b* the inverted keel section 11 has a curved shape, seen from a cross-sectional view. The inverted keel section 11 with a curved shape may be subjected to reduced normal force, thereby alleviating friction between the bucket floor 7 and the material to be loaded or unloaded. This embodiment may comprise the rail sections 3, 4, as shown, even though it also could be without such rail sections.

The width w of the floor section 11 may be the same along at least a part of the longitudinal direction of the inverted keel section (FIG. 3). Alternatively, the width w of the inverted keel section 11 may vary along at least a part of the longitudinal direction of the inverted keel section.

Figure 4C:
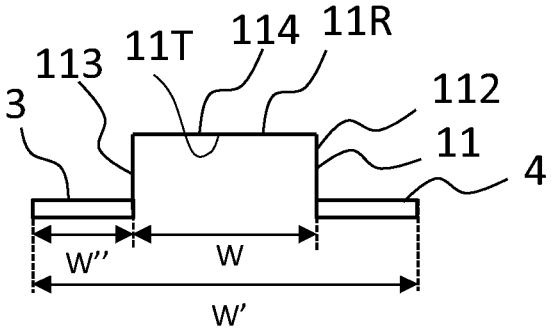
FIG. 4*c* shows a cross-sectional view of one inverted keel section according to an embodiment of the present disclosure.

Optionally, as exemplified in the embodiment shown in FIG. 4*c*, the inverted keel section 11 may be U-shaped, seen from a cross-sectional view. For example, the U-shaped cross-section of the inverted keel section 11 may be formed by a first and a second side wall 112, 113 and a top wall 114 interconnecting the first and second side walls. The U-shaped cross-section may be formed by e.g. bending a sheet metal element, and/or by connecting one or more separate sheet metal elements. The separate sheet metal elements may be connected by welds at the interfaces between the top portion 114 and the respective first and second side wall 112, 113. This embodiment may comprise the rail sections 3, 4, as shown, even though it also could be without such rail sections. Providing a U-shaped cross section as exemplified herein may provide a robust inverted keel section 11 which also may facilitate manufacturing.

Figure 4D:
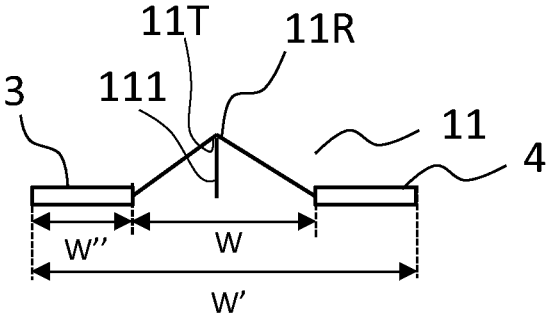
FIG. 4*d* shows a cross-sectional view of one inverted keel section according to an embodiment of the present disclosure.

Optionally, as exemplified in the embodiment shown in FIG. 4*d*, the inverted keel section 11 may further comprise at least one protection member 111 for protecting the inverted keel element from impacts during use, wherein the protection member extends from the trough portion 11T away from the inside of the bucket, i.e. in a downward direction as seen when the bucket is placed on a ground surface. The protection member 111 may as shown be attached to the inverted keel section 11 at the trough portion 11T and it may further extend over at least a portion of the inverted keel section 11 in the longitudinal direction thereof. In an example embodiment, the protection member 111 extends over at least 50% of a length of the inverted keel section 11 in the longitudinal direction from the front cutting edge 8 up to the top portion 2. The protection member 111 may be a sheet metal element, or a number of separate sheet metal elements, which may be connected. By use of the protection member 111, the inverted keel section 11 can be protected from coming into direct contact with external elements, such as large stones. Thereby the protection member 111 may reduce the risk of damaging the inverted keel element 11 during use.

Optionally, in one embodiment as shown in FIG. 1, the floor section 11 has a width w which tapers in a direction towards the front cutting edge 8, forming a tapering floor portion in the proximity of the front cutting edge 8. This may improve the flow characteristics of material into or outwards of the bucket when the bucket is in use.

Optionally, the inverted keel section 11 may be made of sheet metal, such as by one single piece of sheet metal or by more than one piece of attached sheet metal parts. The single piece sheet metal or the attached sheet metal parts has/have two opposing main surfaces, whereby one of the main surfaces forms the trough portion 11T on the outside and the other one of the main surfaces forms the ridge portion 11R on the inside.

The optional at least one weld interface between the at least one floor section 11 and the bucket floor 7 is preferably provided along an edge of the tapering floor portion (FIG. 1).

The invention claimed is:

1. A bucket for an earth-working or materials-handling machine, comprising, a top portion, a first bucket side wall and a second bucket side wall, a bucket floor extending from a front cutting edge up to the top portion, wherein:

the front cutting edge, the first and second side walls and the top portion form a bucket opening, seen from a front view of the bucket, and the bucket floor has an inside facing towards the bucket opening and an outside facing away from the bucket opening, characterized in that the bucket further comprises:

an inverted keel section being attached to the bucket floor, optionally by at least one weld interface between the inverted keel section and the bucket floor provided in the proximity of the front cutting edge, wherein the inverted keel section has a trough portion on the outside and a ridge portion on the inside; and at least one protection element for protecting at least a part of the inverted keel section, and/or at least a part of the optional at least one weld interface, wherein the at least one protection element is mounted on the inside of the bucket floor in the proximity of the front cutting edge, wherein the at least one protection element, seen from above, comprises opposite side edges that converge to a vertex in a direction from the inside of the bucket floor toward the front cutting edge.

2. The bucket according to claim 1, wherein the at least one protection element is attached to the bucket floor by at least one weld interface between the at least one protection element and the bucket floor.

3. The bucket according to claim 1, wherein the at least one protection element is detachably attached to the bucket floor by at least one mechanical fastening means.

4. The bucket according to claim 3, wherein the at least one protection element is at least detachably attached to the inverted keel section.

5. The bucket according to claim 3, wherein the at least one mechanical fastening means is a bolt and/or a screw and/or a quick-lock-mechanism and/or a quick-release-mechanism.

6. The bucket according to claim 1, wherein the at least one protection element extends from the proximity of the front cutting edge and over at least a portion of the inverted keel section, and/or at least a portion of the optional at least one weld interface between the inverted keel section and the bucket floor.

7. The bucket according to claim 1, wherein the protection element further extends over at least a portion of the ridge portion.

8. The bucket according to claim 1, wherein the at least one protection element has a substantially triangular form.

9. The bucket according to claim 1, wherein the at least one protection element consists of one single piece of material.

10. The bucket according to claim 1, wherein the bucket floor comprises a first rail section and a second rail section.

11. The bucket according to claim 10, wherein each one of the rail sections comprises at least one detachable wear component connected to the bucket floor.

12. The bucket according to claim 10, wherein the inverted keel section is provided in-between the first and second rail sections, as seen in a width direction of the bucket.

13. The bucket according to claim 1, wherein the inverted keel section has a width which tapers in a direction towards the front cutting edge, forming a tapering floor portion in the proximity of the front cutting edge, and wherein the optional at least one weld interface between the inverted keel section and the bucket floor is provided along an edge of the tapering floor portion.

14. The bucket according to claim 1, wherein the inverted keel section is made of a single piece of sheet metal or attached sheet metal parts which has/have two opposing main surfaces, whereby one of the main surfaces forms the trough portion on the outside and the other one of the main surfaces forms the ridge portion on the inside.

* * * * *